US006887051B2

(12) United States Patent
Sakuda et al.

(10) Patent No.: US 6,887,051 B2
(45) Date of Patent: May 3, 2005

(54) SCROLL AIR SUPPLY APPARATUS HAVING A MOTOR SHAFT AND A MECHANISM SHAFT

(75) Inventors: Atsushi Sakuda, Shiga (JP); Kiyoshi Sawai, Shiga (JP); Noboru Iida, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/357,417

(22) Filed: Feb. 4, 2003

(65) Prior Publication Data

US 2003/0147763 A1 Aug. 7, 2003

(30) Foreign Application Priority Data

Feb. 5, 2002 (JP) ..... 2002-028206

(51) Int. Cl.[7] ..... F04C 18/00

(52) U.S. Cl. ..... 418/55.2; 418/55.3; 418/55.4; 418/55.5; 417/410.5

(58) Field of Search ..... 418/55.2, 55.3, 418/55.4, 55.5, 151; 417/410.5

(56) References Cited

U.S. PATENT DOCUMENTS

| | | | | |
|---|---|---|---|---|
| 4,466,784 A | * | 8/1984 | Hiraga | 418/55.2 |
| 4,475,875 A | * | 10/1984 | Sugimoto et al. | 418/55.2 |
| 4,594,061 A | * | 6/1986 | Terauchi | 418/55.2 |
| 5,336,068 A | * | 8/1994 | Sekiya et al. | 418/55.2 |
| 5,649,817 A | * | 7/1997 | Yamazaki | 418/55.2 |
| 5,855,473 A | * | 1/1999 | Liepert | 418/55.2 |

FOREIGN PATENT DOCUMENTS

| | | | |
|---|---|---|---|
| JP | 60-233388 | * 11/1985 | 418/55.2 |
| JP | 2-277985 | * 11/1990 | 418/55.2 |
| JP | 5-296168 | 11/1993 | |
| JP | 7-54784 | 2/1995 | |
| JP | 7-286586 | 10/1995 | |
| JP | 7-332264 | 12/1995 | |
| JP | 8-165993 | 6/1996 | |

OTHER PUBLICATIONS

Partial European Search Report dated Sep. 11, 2003.

* cited by examiner

*Primary Examiner*—Thomas Denion
*Assistant Examiner*—Theresa Trieu
(74) *Attorney, Agent, or Firm*—Armstrong, Kratz, Quintos, Hanson & Brooks, LLP

(57) ABSTRACT

It is an object of the present invention to provide an air supply apparatus capable of increasing a height of a scroll lap. The air supply apparatus comprising a stator fixed to a motor frame, a rotor which is fixed to a motor shaft and rotated in the stator, a orbiting scroll which is operated by a mechanism shaft, a stationary scroll for forming a compression space between the stationary scroll itself and the orbiting scroll, and a rotation-restraint member for turning the orbiting scroll, in which the motor shaft and the mechanism shaft are connected to each other, the mechanism shaft passes through the orbiting scroll and the stationary scroll, the mechanism shaft is held by opposite ends of the orbiting scroll, wherein opposite ends of the motor shaft are rotatably held by a first bearing and a second bearing, one end of the mechanism shaft is held by the second bearing.

24 Claims, 8 Drawing Sheets

SCROLL AIR SUPPLY APPARATUS HAVING A MOTOR SHAFT AND A MECHANISM SHAFT

BACKGROUND OF THE INVENTION (1) Field of the Invention

The present invention relates to an air supply apparatus used as a supercharger of an engine or an air compressor of a fuel cell for example.

(2) Description of the Prior Art

Conventionally, some types of gas compressors have been realized, and a scroll compressor is one of them.

The scroll compressor is superior in low vibration characteristics and low noise characteristics due to its mechanism, but in order to increase a discharge amount thereof, it is necessary to increase a height of a scroll lap or its size in its diametrical direction, thereby increasing a compression space.

However, if a diameter of the scroll lap is increased, a centrifugal force generated by rotation is also increased, and another members including a shaft are also increased in size.

SUMMARY OF THE INVENTION

Thereupon, it is an object of the present invention to provide an air supply apparatus capable of increasing a height of the scroll lap.

It is another object of the invention to provide an air supply apparatus in which a motor shaft and a mechanism shaft can easily be aligned and power transmitting efficiency can be enhanced.

It is another object of the invention to provide an air supply apparatus capable of maintaining a clearance between a orbiting scroll lap and a stationary scroll lap at a predetermined distance.

It is another object of the invention to provide an air supply apparatus capable of preventing efficiency from being deteriorated by preventing back flow of compressed air leaked between the mechanism shaft and an orbiting scroll.

It is another object of the invention to provide an air supply apparatus capable of restraining the orbiting scroll from capsizing and the vibration at a low speed.

It is another object of the invention to provide an air supply apparatus capable of the orbiting scroll lap and the stationary scroll lap from being damaged.

It is another object of the invention to provide an oilfree air supply apparatus.

A first aspect of the present invention provides an air supply apparatus comprising a stator fixed to a motor frame, a rotor which is fixed to a motor shaft and rotated in the stator, a orbiting scroll which is operated by a mechanism shaft, a stationary scroll for forming a compression space between the stationary scroll itself and the orbiting scroll, and a rotation-restraint member for orbiting the orbiting scroll, in which the motor shaft and the mechanism shaft are connected to each other, the mechanism shaft passes through the orbiting scroll and the stationary scroll, the mechanism shaft is held by opposite ends of the orbiting scroll, wherein opposite ends of the motor shaft are rotatably held by a first bearing and a second bearing, one end of the mechanism shaft is held by the second bearing.

According to the air supply apparatus of the first aspect of the present invention, opposite ends of the motor shaft are rotatably held by the first bearing and the second bearing, one end of the mechanism shaft is held by the second bearing. In this aspect, the motor shaft and the mechanism shaft are connected to each other, the mechanism shaft passes through the orbiting scroll and the stationary scroll, and the mechanism shaft is held by the opposite ends of the orbiting scroll. Therefore, the shaft comprising the motor shaft and the mechanism shaft is held by the three bearings and commonly uses the second bearing, and both the motor shaft and mechanism shaft are held at opposite ends. According to this aspect, since another connecting member or power transmitting mechanism does not exist between the motor shaft and the mechanism shaft, it is easy to align the motor shaft and the mechanism shaft to each other, and the power transmitting efficiency is enhanced. Further, since it is easy to align the motor shaft and the mechanism shaft to each other and it is possible to prevent the shafts from being inclined, it is also possible to prevent the orbiting scroll from being inclined with respect to the stationary scroll. Therefore, according to this aspect, since it is possible to maintain the clearance between the orbiting scroll lap and the stationary scroll lap at the predetermined distance, it is possible to prevent compressing efficiency from being deteriorated and to prevent equipment from being damaged. According to the aspect, since the shaft is supported by the three bearings and it is possible to maintain the clearance between the orbiting scroll lap and the stationary scroll lap at the predetermined distance, it is possible to realize an oilfree air supply apparatus.

A second aspect of the invention provides an air supply apparatus comprising a stator fixed to a motor frame, a rotor which is fixed to a motor shaft and rotated in the stator, a orbiting scroll which is operated by a mechanism shaft, a stationary scroll for forming a compression space between the stationary scroll itself and the orbiting scroll, and a rotation-restraint member for orbiting the orbiting scroll, in which the motor shaft and the mechanism shaft are connected to each other, the mechanism shaft passes through the orbiting scroll and the stationary scroll, the mechanism shaft is held by opposite ends of the orbiting scroll, wherein a diameter of the mechanism shaft is 1.0 to 1.5 times greater than that of the motor shaft.

According to the air supply apparatus of the second aspect of the invention, the diameter of the mechanism shaft is 1.0 to 1.5 times greater than that of the motor shaft. In this aspect, since the diameter of the mechanism shaft is 1.0 to 1.5 times greater than that of the motor shaft, bending of the orbiting scroll or the shaft itself caused by a centrifugal force can be reduced. Therefore, according to this aspect, since it is possible to maintain the clearance between the orbiting scroll lap and the stationary scroll lap at the predetermined distance, it is possible to prevent compressing efficiency from being deteriorated and to prevent equipment from being damaged. According to the aspect, since it is possible to maintain the clearance between the orbiting scroll lap and the stationary scroll lap at the predetermined distance, it is possible to realize an oilfree air supply apparatus.

A third aspect of the invention provides an air supply apparatus comprising a stator fixed to a motor frame, a rotor which is fixed to a motor shaft and rotated in the stator, a orbiting scroll which is operated by a mechanism shaft, a stationary scroll for forming a compression space between the stationary scroll itself and the orbiting scroll, and a rotation-restraint member for orbiting the orbiting scroll, in which the motor shaft and the mechanism shaft are connected to each other, the mechanism shaft passes through the orbiting scroll and the stationary scroll, the mechanism shaft is held by opposite ends of the orbiting scroll, wherein the orbiting scroll is held by the mechanism shaft using two bearings, a shaft seal is provided between the two bearings.

In the air supply apparatus of the third aspect of the invention, the orbiting scroll is held by the mechanism shaft with two bearings, and the shaft seal is provided between the two bearings. In this aspect, the mechanism shaft passes through the orbiting scroll and the stationary scroll, and the mechanism shaft is held by the opposite ends of the orbiting scroll. Therefore, compressed air enters between the mechanism shaft and the orbiting scroll. According to this aspect, since back flow of compressed air leaked between the mechanism shaft and a orbiting scroll is prevented, it is possible to prevent the efficiency from being deteriorated. Further, according to the aspect, since grease in the bearing is prevented from leaking out by flow of compressed air, it is possible to maintain the function of the bearing which holds the orbiting scroll, and it is possible to realize an oilfree air supply apparatus.

A fourth aspect of the invention provides an air supply apparatus comprising a stator fixed to a motor frame, a rotor which is fixed to a motor shaft and rotated in the stator, a orbiting scroll which is operated by a mechanism shaft, a stationary scroll for forming a compression space between the stationary scroll itself and the orbiting scroll, and a rotation-restraint member for orbiting the orbiting scroll, in which the motor shaft and the mechanism shaft are connected to each other, the mechanism shaft passes through the orbiting scroll and the stationary scroll, the mechanism shaft is held by opposite ends of the orbiting scroll, wherein the orbiting scroll is held by the mechanism shaft using a bearing, the air supply apparatus further comprises a pre-load spring for pressing the bearing in a direction in which the orbiting scroll is separated from the stationary scroll.

According to the air supply apparatus of the fourth aspect of the invention, the orbiting scroll is held by the mechanism shaft using the bearing, and air supply apparatus has the pre-load spring for pressing the bearing in a direction in which the orbiting scroll is separated from the stationary scroll. In this aspect, since the pressing force is applied by the pre-load spring to the direction in which the orbiting scroll is separated from the stationary scroll, i.e., in a thrust direction, it is possible to restrain the orbiting scroll from capsizing and the vibration at a low speed.

A fifth aspect of the invention provides an air supply apparatus comprising a stator fixed to a motor frame, a rotor which is fixed to a motor shaft and rotated in the stator, a orbiting scroll which is operated by a mechanism shaft, a stationary scroll for forming a compression space between the stationary scroll itself and the orbiting scroll, and a rotation-restraint member for orbiting the orbiting scroll, in which the motor shaft and the mechanism shaft are connected to each other, the mechanism shaft passes through the orbiting scroll and the stationary scroll, the mechanism shaft is held by opposite ends of the orbiting scroll, wherein a orbiting scroll lap having a predetermined height stands on one of surfaces of the orbiting scroll, a boss portion stands on a center portion of the orbiting scroll lap, a lap-reinforcing portion is formed between an outer peripheral surface of the boss portion and the orbiting scroll lap, the lap-reinforcing portion is provided from a center-side end of the orbiting scroll lap by a predetermined length at a height lower than the orbiting scroll lap.

According to the air supply apparatus of the fifth aspect, the lap-reinforcing portion is formed between the outer peripheral surface of the boss portion and the orbiting scroll lap, and the lap-reinforcing portion is provided at a height lower than the orbiting scroll lap from its center-side end by a predetermined length. In this aspect, by setting the lap-reinforcing portion to a predetermined length from the center-side end of the orbiting scroll lap, a strength of the orbiting scroll lap at a location where an especially high pressure is applied is secured, and it is possible to prevent the orbiting scroll lap from being damaged. Further, by setting the lap-reinforcing portion at the height lower than the orbiting scroll lap, it is possible to secure a discharging path for compressed air.

A sixth aspect of the invention provides an air supply apparatus comprising a stator fixed to a motor frame, a rotor which is fixed to a motor shaft and rotated in the stator, a orbiting scroll which is operated by a mechanism shaft, a stationary scroll for forming a compression space between the stationary scroll itself and the orbiting scroll, and a rotation-restraint member for orbiting the orbiting scroll, in which the motor shaft and the mechanism shaft are connected to each other, the mechanism shaft passes through the orbiting scroll and the stationary scroll, the mechanism shaft is held by opposite ends of the orbiting scroll, wherein a stationary scroll lap having a predetermined height stands on one of surfaces of the stationary scroll, an outer peripheral-side end and a center-side end of the stationary scroll lap are provided with ribs, each of the ribs is formed by further extending the stationary scroll lap, and a height of the rib is lower than that of the stationary scroll lap.

According to the air supply apparatus of the sixth aspect of the invention, the stationary scroll lap stands on one of surfaces of the stationary scroll at a predetermined height, the outer peripheral-side end and the center-side end of the stationary scroll lap are provided with ribs, each of the rib is formed by further extending the stationary scroll lap, and the rib is set at a height lower than the stationary scroll lap. In this aspect, since the outer peripheral-side end and the center-side end of the stationary scroll lap are provided with the ribs, it is possible to ensure the strength of the stationary scroll lap, and to increase the lap height.

In a seventh aspect of the invention, in the air supply apparatus according to any one of the first to sixth aspects, a crank portion for decentering the mechanism shaft with respect to the motor shaft is provided with a balance weight.

According to the seventh aspect of the invention, in the air supply apparatus of any one of the first to sixth aspects, the crank portion for decentering the mechanism shaft with respect to the motor shaft is provided with the balance weight. In this aspect, by providing the mechanism shaft with the balance weight which has an opposite ends-supporting structure, bending of the orbiting scroll or the mechanism shaft itself caused by a centrifugal force can be prevented at a position closer to the orbiting scroll or the mechanism shaft.

In an eight aspect of the invention, in the air supply apparatus according to any one of the first to sixth aspects, the mechanism shaft and the motor shaft are integrally formed together.

According to the eighth aspect of the invention, in the air supply apparatus of any one of the first to sixth aspects, the mechanism shaft and the motor shaft are integrally formed together. According to this aspect, it is unnecessary to align the mechanism shaft and the motor shaft to each other when they are assembled, and it is possible to enhance the transmitting efficiency.

In a ninth aspect of the invention, in the air supply apparatus according to the seventh aspect, the balance weight and the crank portion are integrally formed together.

According to the ninth aspect of the invention, in the air supply apparatus of the seventh aspect, the balance weight and the crank portion are integrally formed together. According to this aspect, it is unnecessary to separately produce the balance weight and the crank portion by cutting, and it is also unnecessary to take the balance at the time of assembling into consideration.

In a tenth aspect of the invention, in the air supply apparatus of any one of the first to sixth aspects, a clearance is provided between a side surface of the orbiting scroll lap which stands on the orbiting scroll and a side surface of the stationary scroll lap which stands on the stationary scroll so that both the side surfaces do not come into contact with each other.

According to the tenth aspect of the invention, in the air supply apparatus of any one of the first to sixth aspects, the clearance is provided between the side surface of the orbiting scroll lap standing from the orbiting scroll and the side surface of the stationary scroll lap standing from the stationary scroll so that both the side surfaces do not come into contact with each other. According to the aspect, since the clearance is secured between the orbiting scroll lap and the stationary scroll lap, it is possible to realize an oilfree air supply apparatus.

In an eleventh aspect of the invention, in the air supply apparatus of the tenth aspect, tip end surfaces of the orbiting scroll lap and the stationary scroll lap are respectively provided with tip seals.

According to the eleventh aspect of the invention, in the air supply apparatus of the tenth aspect, the tip seals are provided on the end surfaces of tip ends of the orbiting scroll lap and the stationary scroll lap. According to the aspect, the tip end of the orbiting scroll lap and the stationary scroll lap come into contact with each other through the tip seal, and the tip end of the stationary scroll lap and the orbiting scroll come into contact with each other through the tip seal. Since the orbiting scroll lap and the stationary scroll lap are not directly contacted with each other, it is possible to realize an oilfree air supply apparatus.

In a twelfth aspect of the invention, in the air supply apparatus of any one of the first to sixth aspects, the rotation-restraint member comprises a crankpin, and the crankpin is provided at its opposite ends with bearings.

According to the twelfth aspect of the invention, in the air supply apparatus of any one of the first to sixth aspects, the rotation-restraint member is constituted by the crankpin, and the crankpin is provided at its opposite ends with bearings. According to the aspect, in order to prevent the orbiting scroll from rotating by the crankpin caused by the rotating motion, directions of the rotation of the shaft and the centrifugal force are in synchronization with each other. Therefore, it becomes easy to keep balance of rotation. In the aspect, since the bearing filled with grease is used, it is unnecessary to supply the lubricating oil to the rotation-restraint member, and it is possible to realize an oilfree air supply apparatus.

In a thirteenth aspect of the invention, in the air supply apparatus of any one of the first to sixth aspects, the orbiting scroll is provided at its back surface with a notch for aligning a center of gravity of the orbiting scroll to an axis of the mechanism shaft.

According to the thirteenth aspect of the invention, in the air supply apparatus of any one of the first to sixth aspects, the orbiting scroll is provided at its back surface with a notch for aligning a center of gravity of the orbiting scroll to an axis of the mechanism shaft. According to the aspect, since the orbiting scroll is provided at its back surface with the notch, degrees of freedom of shape, size and layout of the notch are increased. Since the center of gravity of the orbiting scroll is aligned to the center of the shaft by this notch, and the centrifugal force is made constant, it becomes easy to keep balance of rotation.

In a fourteenth aspect of the invention, in the air supply apparatus of any one of the first to sixth aspects, the mechanism shaft is provided at its opposite ends with balance weights.

According to the fourteenth aspect of the invention, in the air supply apparatus of any one of the first to sixth aspects, the mechanism shaft is provided at its opposite ends with balance weights. According to the aspect, the mechanism shaft whose opposite ends are supported is provided with the balance weights, bending of the orbiting scroll or the mechanism shaft itself caused by a centrifugal force can be prevented at a position close to the orbiting scroll or the mechanism shaft.

A fifteenth aspect of the invention provides an assembling method of an air supply apparatus, the air supply apparatus including:

a motor portion comprising a cylindrical motor frame, a stator fixed to an inner surface of the motor frame, a rotor which is fixed to a motor shaft and rotated in the stator, and a motor bearing plate for closing one end surface of the motor frame, one end of the motor shaft being rotatably held by a first bearing provided at a center portion of the motor bearing plate;

a compressing portion comprising a orbiting scroll which is operated by a mechanism shaft, and a stationary scroll for forming a compression space between the stationary scroll itself and the orbiting scroll, a orbiting scroll lap standing on the orbiting scroll and a stationary scroll lap standing on the stationary scroll are meshed with each other; and a casing comprising a partition disk for closing the other end surface of the motor frame and one end surface of the compressing portion, the other end of the motor shaft being rotatably held by a second bearing mounted to a center portion of the partition disk, the motor shaft and the mechanism shaft are integrally coupled to each other to form a shaft, wherein the motor portion is previously assembled, and in a state in which the shaft is supported at its two points by the first bearing and the second bearing, the orbiting scroll and the stationary scroll are inserted into the shaft from its other end side, thereby carrying out alignment thereof.

According to the assembling method of the air supply apparatus of the fifteenth aspect of the invention, the motor portion is previously assembled, and in a state in which the shaft is supported at two points by the first bearing and the second bearing, the orbiting scroll and the stationary scroll are inserted from the other end of the shaft and aligned to each other. According to this aspect, since the motor portion is previously assembled, the shaft is supported at two points by the first bearing and the second bearing. Therefore, it is possible to effectively prevent the shaft from being inclined. Thus, it becomes easy to align the orbiting scroll and the stationary scroll when they are assembled, and it is possible to uniform the clearance between the orbiting scroll lap and the stationary scroll lap.

A sixteenth aspect of the invention provides an assembling method of an air supply apparatus, the air supply apparatus including:

a compressing portion comprising a orbiting scroll which is operated by a mechanism shaft, and a stationary scroll for forming a compression space between the stationary scroll itself and the orbiting scroll, a orbiting scroll lap standing on the orbiting scroll and a stationary scroll lap standing on the stationary scroll are meshed with each other; and a casing comprising a partition disk for closing one end surface of the compressing portion, the other end of the motor shaft being rotatably held by a bearing mounted to a center portion of the partition disk, the motor shaft and the mechanism shaft are integrally coupled to each other to form a shaft, wherein in a state in which the shaft is supported at its two points by the bearing and a jig which holds one end of the motor shaft, the orbiting scroll and the stationary scroll are inserted into the shaft from its other end side, thereby carrying out alignment thereof.

According to the assembling method of the air supply apparatus of the sixteenth aspect of the invention, in a state in which the shaft is supported at two points by the bearing and the jig which holds the one end of the motor shaft, the orbiting scroll and the stationary scroll are inserted from the other end of the shaft to carry out alignment. According to this aspect, since the shaft is supported at two points by the bearing and the jig which holds the one end of the motor shaft, it is possible to effectively prevent the shaft from being inclined. Thus, it becomes easy to align the orbiting scroll and the stationary scroll when they are assembled, and it is possible to uniform the clearance between the orbiting scroll lap and the stationary scroll lap.

DESCRIPTION OF THE PREFERRED EMBODIMENT

An embodiment of an air supply apparatus of the present invention will be explained below based on the drawings.

Figure 1:
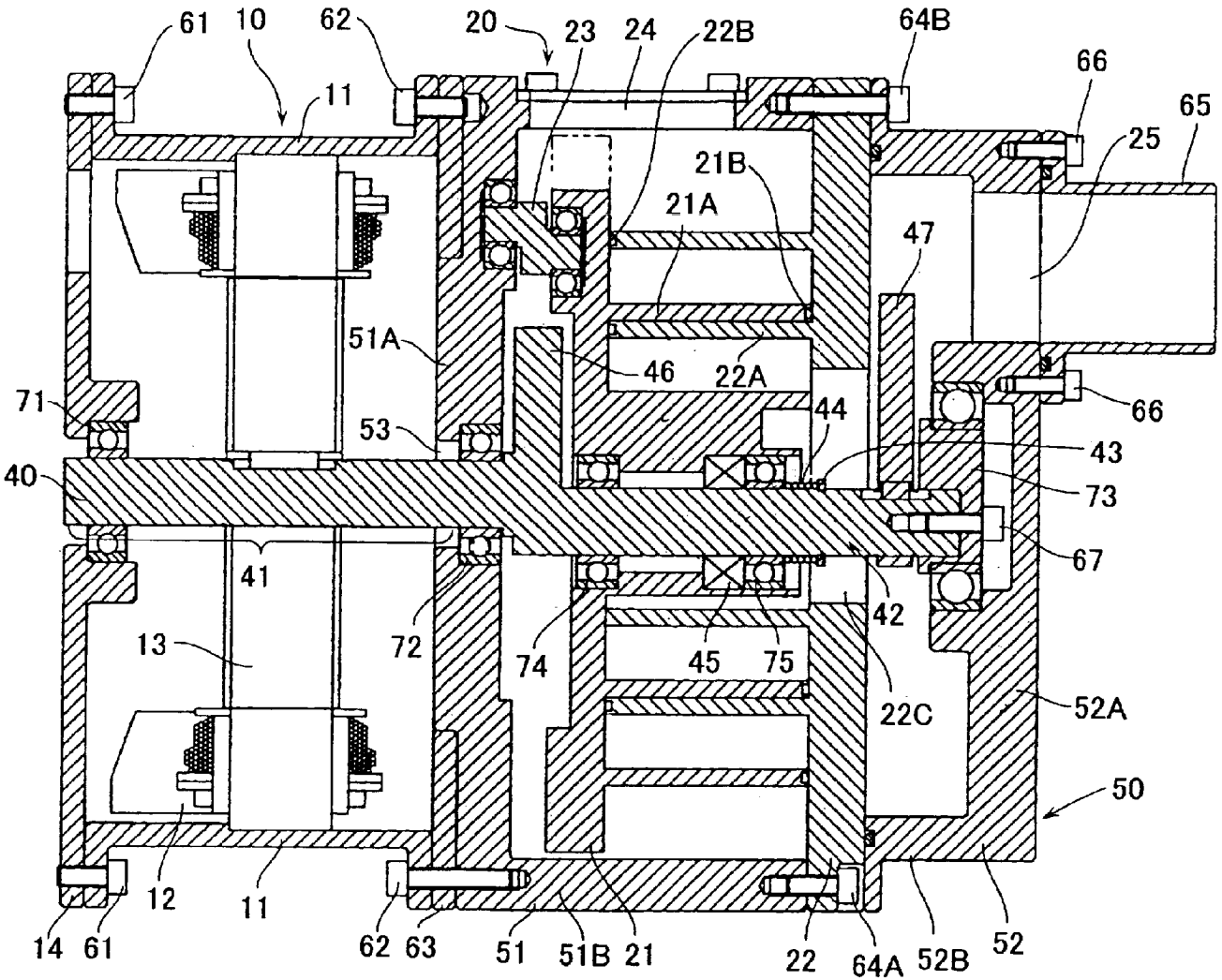
FIG. 1 is a side sectional view showing an entire structure of an air supply apparatus according to an embodiment of the present invention.
Figure 2:
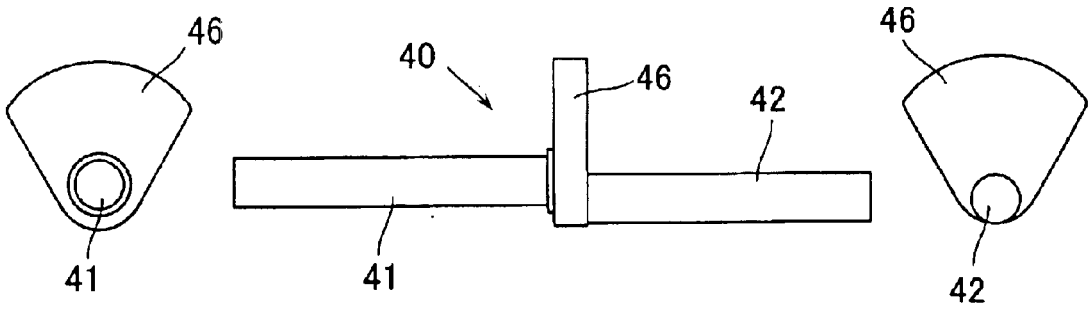
FIG. 2 is a side view of a shaft of the air supply apparatus of the embodiment.
Figure 3:
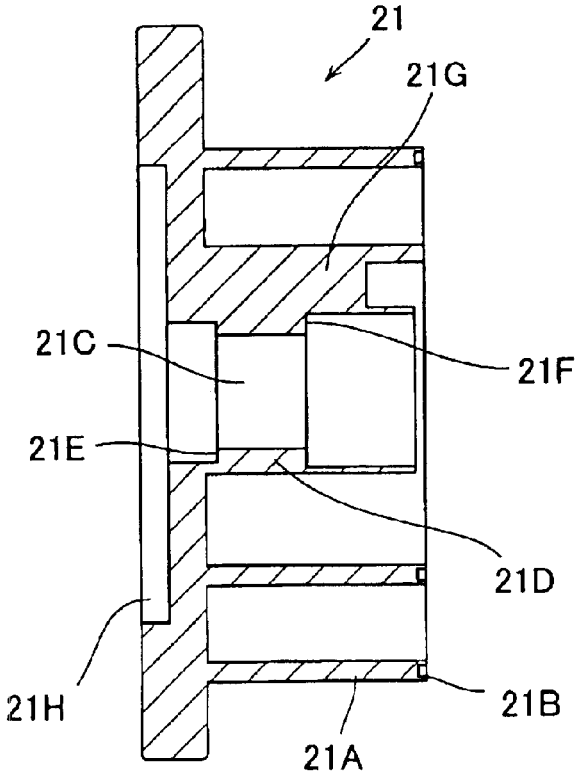
FIG. 3 is a side sectional view showing a orbiting scroll of the air supply apparatus of the embodiment.
Figure 4:
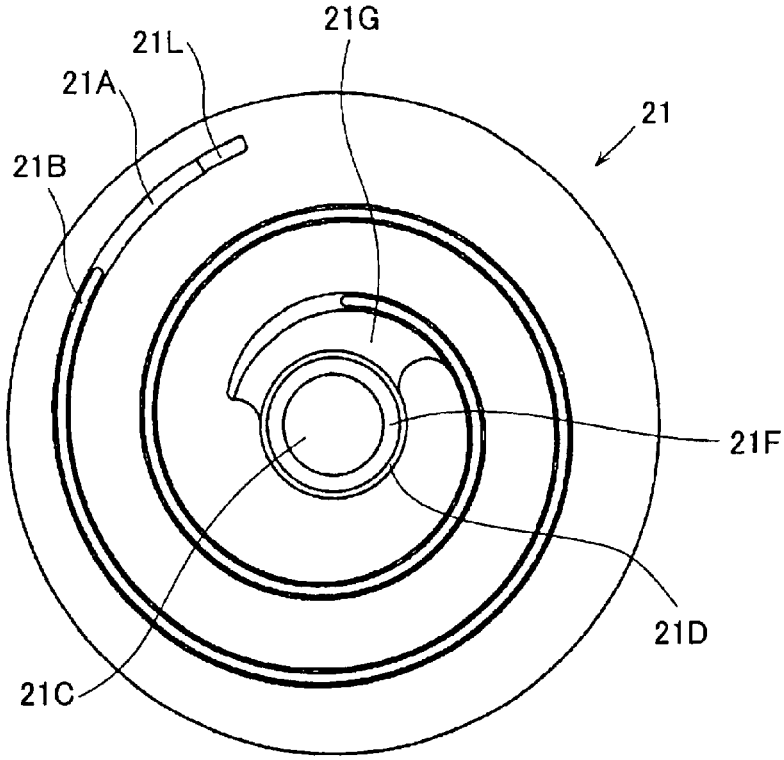
FIG. 4 is a front view showing the orbiting scroll of the air supply apparatus of the embodiment.
Figure 5:
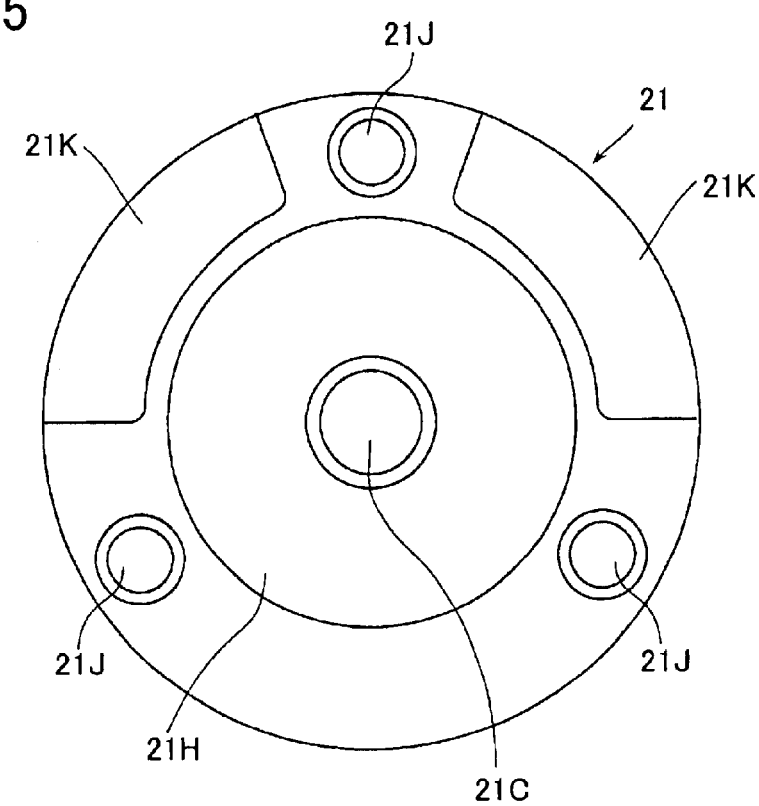
FIG. 5 is a rear view showing the orbiting scroll of the air supply apparatus of the embodiment.
Figure 6:
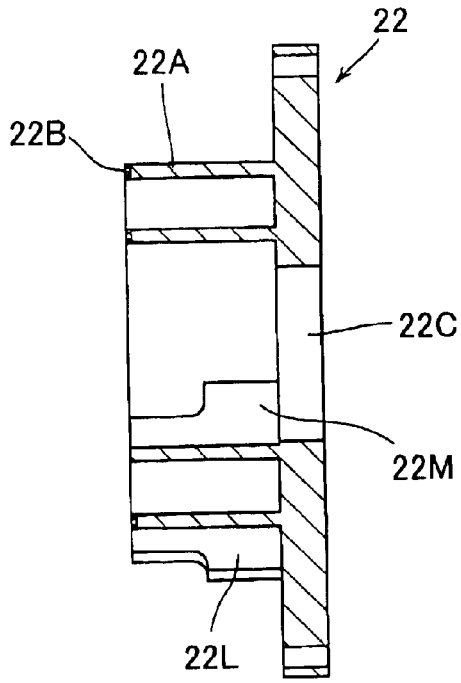
FIG. 6 is a side sectional view showing a stationary scroll of the air supply apparatus of the embodiment.
Figure 7:
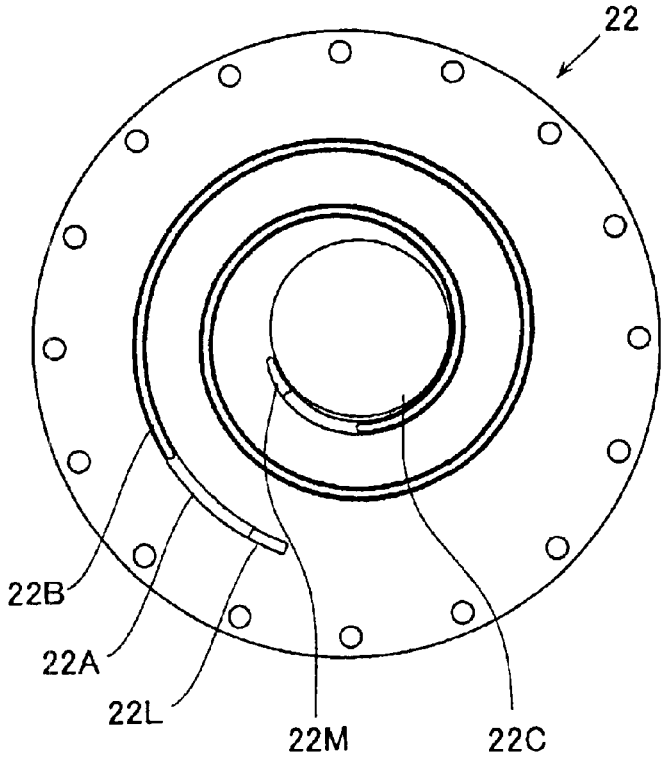
FIG. 7 is a front view showing the stationary scroll of the air supply apparatus of the embodiment.

FIG. 1 is a side sectional view showing an entire structure of an air supply apparatus according to an embodiment of the present invention. FIG. 2 is a side view of a shaft of the air supply apparatus of the embodiment. FIG. 3 is a side sectional view showing a orbiting scroll of the air supply apparatus of the embodiment. FIG. 4 is a front view showing the orbiting scroll of the air supply apparatus of the embodiment. FIG. 5 is a rear view showing the orbiting scroll of the air supply apparatus of the embodiment. FIG. 6 is a side sectional view showing a stationary scroll of the air supply apparatus of the embodiment. FIG. 7 is a front view showing the stationary scroll of the air supply apparatus of the embodiment.

As shown in FIG. 1, the air supply apparatus of the embodiment has a casing 50 in which a motor portion 10 and a compressing portion 20 are accommodated.

The motor portion 10 comprises a cylindrical motor frame 11, a stator 12 fixed to an inner surface of the motor frame 11, a rotor 13 which is fixed to a motor shaft 41 and rotated in the stator 12, and a motor bearing plate 14 for closing one end surface of the motor frame 11. The motor bearing plate 14 is connected to an outer periphery of the plate of the motor frame 11 through a connecting member 61 such as a bolt. The motor bearing plate 14 is provided at its center portion with a bearing 71, and one end of the motor shaft 41 is rotatably held by the bearing 71.

The casing 50 comprises a first casing 51 for closing the other end surface of the motor frame 11 and covering one end surface and an outer periphery of the compressing portion 20, and a second casing 52 disposed on the other end surface of the compressing portion 20.

The compressing portion 20 comprises an orbiting scroll 21 which is operated by a mechanism shaft 42, a stationary scroll 22 for forming a compression space between the stationary scroll 22 and the orbiting scroll 21, and a rotation-restraint member 23 for orbiting the orbiting scroll 21. A orbiting scroll lap 21A having a predetermined height stands on the orbiting scroll 21. A stationary scroll lap 22A having a predetermined height stands on the stationary scroll 22. The orbiting scroll lap 21A and the stationary scroll lap 22A are disposed such that they mesh with each other. A clearance is provided between a side surface of the orbiting scroll lap 21A and a side surface of the stationary scroll lap 22A so that they do not come into contact with each other. Tip seals 21B and 22B are provided on tip end surfaces of the orbiting scroll lap 21A and the stationary scroll lap 22A. Therefore, the tip end of the orbiting scroll lap 21A and the stationary scroll 22 come into contact with each other through the tip seal 21B, and the tip end of the stationary scroll lap 22A and the orbiting scroll 21 come into contact with each other through the tip seal 22B.

The first casing 51 comprises a disk-like partition disk 51A for closing the other end surface of the motor frame 11 and the one end surface of the compressing portion 20, and a cylindrical member 51B for covering an outer periphery of the compressing portion 20. An outer periphery of the partition disk 51A is connected to the motor frame 11 to each other through a connecting member 62 such as a bolt. It is preferable that the partition disk 51A and the motor frame 11 are connected to each other through a positioning plate 63. The partition disk 51A is provided at its center portion with a through hole 53. The through hole 53 is provided with a bearing 72. The other end of the motor shaft 41 is rotatably held by the bearing 72. The cylindrical member 51B has a suction port 24 for introducing air to the compressing portion 20. An opened end of the cylindrical member 51B is connected to the stationary scroll 22 through a connecting member 64A such as a bolt. As shown in FIG. 7, the stationary scroll 22 is provided with sixteen bolt holes. The cylindrical member 51B and the stationary scroll 22 are connected to each other using eight connecting members 64A and every other bolt holes.

The second casing 52 comprises a disk-like plate 52A, and a cylindrical member 52B connected to an outer peripheral end of the plate 52A. An opened end of the cylindrical member 52B is connected to the stationary scroll 22 through connecting members 64B. The cylindrical member 52B and the stationary scroll 22 are connected to each other using eight connecting members 64B. The plate 52A is provided at its center portion with an eccentric bearing 73. The other end of the mechanism shaft 42 is rotatably held by the eccentric bearing 73. The plate 52A has a discharging port 25 for discharging air which is compressed by the compressing portion 20. A discharging pipe 65 is connected to the discharging port 25 through a connecting member 66 such as a bolt. The mechanism shaft 42 and the eccentric bearing 73 are connected to each other through a connecting member 67 such as a bolt.

The rotation-restraint member 23 restrains rotation of the orbiting scroll 21 around the mechanism shaft 42 so that the orbiting scroll 21 can turn only around the motor shaft 41. More specifically, the rotation-restraint member 23 comprises a crankpin disposed between the first casing 51 and the orbiting scroll 21. The crankpin 23 is provided at its opposite ends with bearings. It is preferable that the bearing is a ball bearing filled with grease. Three crankpins 23 are provided between the partition disk 51A and the orbiting scroll 21. The crankpins 23 are provided at equal distances from one another with equal distance from the mechanism shaft 42. It is preferable that three or more crankpins 23 are provided.

A shaft 40 will be explained using FIGS. 1 and 2.

The shaft 40 comprises the motor shaft 41 and the mechanism shaft 42 which are integrally formed together. One end, an intermediate portion and the other end of the shaft 40 are rotatably supported by the bearing 71, the bearing 72 and the eccentric bearing 73, respectively. The motor shaft 41 is held by the bearing 71 and the bearing 72, and the mechanism shaft 42 is held by the bearing 72 and the eccentric bearing 73. Therefore, the motor shaft 41 and the mechanism shaft 42 are supported at their both ends. The mechanism shaft 42 is eccentric with respect to the motor shaft 41 in the crank portion. A diameter of the mechanism shaft 42 is 1.0 to 1.5 times greater than that of the motor shaft 41. More preferably, the diameter of the mechanism shaft 42 is 1.1 to 1.4 times greater than that of the motor shaft 41. In this embodiment, lengths of the motor shaft 41 and the mechanism shaft 42 are 150 mm, and materials thereof are iron.

The mechanism shaft 42 is provided with bearings 74 and 75. The orbiting scroll 21 is rotatably held by the two bearings 74 and 75. The bearing 74 is disposed on a root side of the orbiting scroll lap 21A, and the bearing 75 is disposed on a tip end side of the orbiting scroll lap 21A. It is preferable that the bearings 72, 74 and 75, and the eccentric bearing 73 are ball bearings filled with grease.

The mechanism shaft 42 is provided with a span ring 43. The span ring 43 is provided at a position closer to the eccentric bearing 73 than the bearing 75. A pre-load spring 44 is disposed between the span ring 43 and the bearing 75 in a state in which a compression load is applied to the pre-load spring 44. Therefore, the pre-load spring 44 presses an inner wheel side member of the bearing 75 against the motor portion 10, and since the inner wheel side member of the bearing 75 is pressed against the motor portion 10, its pressing force is transmitted to an outer wheel side member of the bearing 75 through a ball and as a result, the pre-load spring 44 presses the orbiting scroll 21 against the motor portion 10. The pressing force applied to the orbiting scroll 21 is received by the crankpin 23, and it is possible to restrain the orbiting scroll 21 from capsizing at the time of low speed driving, and to restrain the vibration.

The mechanism shaft 42 has a shaft seal 45. The shaft seal 45 is provided between the bearing 74 and the bearing 75 and at a position closer to the bearing 75. The shaft seal 45 prevents compressed air from leaking toward the bearing 74.

The shaft 40 is provided at its crank portion with a balance weight 46. As shown in FIG. 2, the balance weight 46 has a fan-shape and is integrally formed with the shaft 40.

The shaft 40 is also provided with a balance weight 47 having the same shape as that of the balance weight 46. The balance weight 47 is provided in the vicinity of the eccentric bearing 73.

The balance weights 46 and 47 keep rotation balance by applying centrifugal forces which are in balance with centrifugal forces generated by the orbiting scroll 21 and the mechanism shaft 42.

The orbiting scroll 21 will be explained using FIGS. 3 to 5.

The orbiting scroll lap 21A having the predetermined height stands on the one surface of the orbiting scroll 21. The orbiting scroll lap 21A comprises an involute curve or a curve close to the involute curve. A tip end surface of the orbiting scroll lap 21A is formed with a groove, and the tip seal 21B is provided in the groove. A shaft-through hole 21C is formed in a center of the orbiting scroll 21, and a boss portion 21D stands from a center portion of the one surface of the orbiting scroll 21. The boss portion 21D is formed at its inner peripheral surface with a step 21E and a step 21F. The bearing 74 is disposed on the step 21E. The shaft seal 45 and the bearing 75 are disposed on the step 21F. A lap-reinforcing portion 21G is formed between the outer peripheral surface of the boss portion 21D and the orbiting scroll lap 21A. The lap-reinforcing portion 21G extends from a center-side end of the orbiting scroll lap 21A by a predetermined length which is lower than the orbiting scroll lap 21A. It is preferable that the lap-reinforcing portion 21G is provided in a range of 90° to 180° around the shaft-through hole 21C.

A circular recess 21H is formed on the other surface of the orbiting scroll 21 around the shaft-through hole 21C. The recess 21H has a diameter which is greater than that of the maximum outer peripheral end of the balance weight 46. A portion of the balance weight 46 can rotate in this recess 21H. Three crankpin recesses 21J are formed in the other surface of the orbiting scroll 21 at equal distances from one another with equal distances from the shaft-through hole 21C. Notches 21K are provided in the other surface of the orbiting scroll 21 at arbitrary positions. These notches 21K are provided for aligning a center of gravity of the orbiting scroll 21 to a center of the shaft-through hole 21C. By centering the center of gravity of the orbiting scroll 21 to the center of the shaft-through hole 21C, it is possible to uniformly generate the centrifugal force and to keep the rotation balance.

The orbiting scroll lap 21A is provided at its outer peripheral-side end with a rib 21L. The rib 21L is formed by further extending the orbiting scroll lap 21A and has an involute curve or a curve close to the involute curve, and the rib 21L is lower than the orbiting scroll lap 21A.

The stationary scroll 22 will be explained using FIGS. 6 and 7.

The stationary scroll lap 22A having the predetermined height stands from the one surface of the stationary scroll 22. The stationary scroll lap 22A has an involute curve or a curve close to the involute curve. The tip end surface of the stationary scroll lap 22A is formed with a groove, and the tip seal 22B is provided in the groove. The stationary scroll 22 is provided at its center portion with a discharge port 22C.

The stationary scroll lap 22A is provided at its outer peripheral-side end with a rib 22L, and at its center-side end with a rib 22M. The ribs 22L and 22M are formed by further extending the stationary scroll lap 22A. Each of the ribs 22L and 22M has an involute curve or a curve close to the involute curve. The ribs 22L and 22M are lower than the stationary scroll lap 22A.

The operation of the air supply apparatus according to the embodiment will be explained below.

The shaft 40 is rotated by rotation of the motor portion 10. The mechanism shaft 42 is eccentrically rotated around a center of the motor shaft 41. Therefore, the orbiting scroll 21 which is connected to the mechanism shaft 42 is also eccentrically rotated around the motor shaft 41. Rotation of the orbiting scroll 21 around the mechanism shaft 42 is restrained by the crankpin 23. Therefore, the orbiting scroll 21 is only turned around the motor shaft 41.

By the turning motion of the orbiting scroll 21, a plurality of compression spaces are formed between the orbiting scroll 21 and the stationary scroll 22. These compression spaces are formed around the outer periphery and then, move toward the center portion while reducing their volumes.

Therefore, air sucked from the suction port 24 is trapped in the compression space formed between the orbiting scroll 21 and the stationary scroll 22, the air moves toward the center portion while being compressed, and is discharged to a space in the second casing 52 from the discharge port 22C, and is discharged into the discharging pipe 65 through the discharging port 25.

The shaft 40 is bent by its rotation. A centrifugal force which is decentered by the orbiting scroll 21 and the mechanism shaft 42 itself is applied especially to the mechanism shaft 42 between the bearing 72 and the eccentric bearing 73. However, it is possible to make the centrifugal force constant and to keep the rotation balance by disposing the balance weight 46 and the balance weight 47 on the mechanism shaft 42 between the bearing 72 and the eccentric bearing 73. Further, by integrally forming the motor shaft 41 and the mechanism shaft 42 together, it is possible to prevent the orbiting scroll 21 from inclining. Therefore, since the orbiting scroll 21 is prevented from inclining with well rotation balance, it is possible to reliably secure a non-contact state between the orbiting scroll 21 and the stationary scroll 22.

On the other hand, the rotated shaft 40 is supported by the bearings 71 and 72 as well as the eccentric bearing 73. Since the bearings 71, 72 and the eccentric bearing 73 are filled with grease, it is unnecessary to supply lubricating oil to the shaft 40. Further, since the orbiting scroll 21 and the stationary scroll 22 are not in contact with each other, it is unnecessary to supply lubricating oil between these members. Since the crankpin provided at its opposite ends with the bearings is employed as the rotation-restraint member 23, it is unnecessary to supply lubricating oil to the rotation-restraint member 23.

As described above, according to the air supply apparatus of the embodiment, it is possible to reliably ensure the non-contact state between the orbiting scroll 21 and the stationary scroll 22, and since lubricating oil is not required for any of the bearings 71 to 73 and the rotation-restraint member 23, it is possible to realize an oilless air supply apparatus.

Further, since the orbiting scroll 21 is held by the mechanism shaft 42 whose opposite ends are supported, heights of the orbiting scroll lap 21A and the stationary scroll lap 22A can be increased. Further, the orbiting scroll lap 21A is provided at its outer peripheral-side end with the rib 21L, the stationary scroll lap 22A is provided at its outer peripheral-side end with the rib 22L, and the stationary scroll lap 22A is provided at its center-side end with the rib 22M. Therefore, even if the heights of the orbiting scroll lap 21A and the stationary scroll lap 22A are increased, it is possible to prevent them from being damaged.

Next, the shaft according to another embodiment will be explained based on the drawings.

Figure 8:
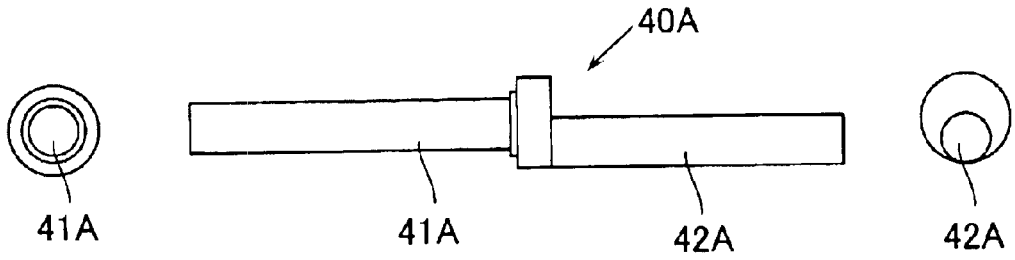
FIG. 8 is a side view of the shaft according to another embodiment of the invention.

FIG. 8 is a side view of the shaft of the other embodiment.

As shown in FIG. 8, the shaft 40A comprises a motor shaft 41A and a mechanism shaft 42A which are integrally formed together. The shaft 40A does not have a crank portion provided with a balance weight as shown in FIG. 2. It is not always necessary to provide the balance weight on the crank portion.

Figure 9:
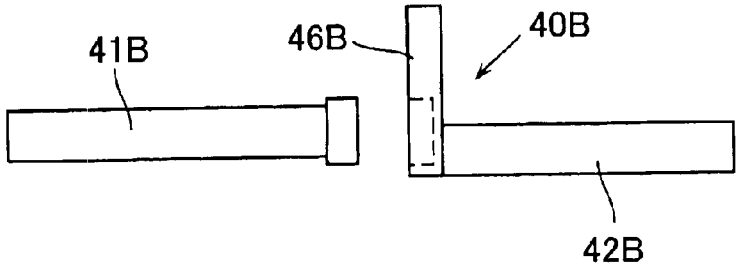
FIG. 9 is a side view of the shaft according to further another embodiment of the invention.

FIG. 9 is a side view of the shaft according to further another embodiment.

As shown in FIG. 9, a shaft 40B of this embodiment has a motor shaft 41B and a mechanism shaft 42B as separate members. A balance weight 46B is integrally formed with a mechanism shaft 42B. The balance weight 46B is formed with a recess into which an end of the motor shaft 41B can be fitted. The end of the motor shaft 41B is formed with a large-diameter portion.

In the shaft 40B of this embodiment, the motor shaft 41B and the balance weight 46B are connected to each other by shrinkage fitting. In this embodiment also, the crank portion is formed by the balance weight 46B.

Figure 10:
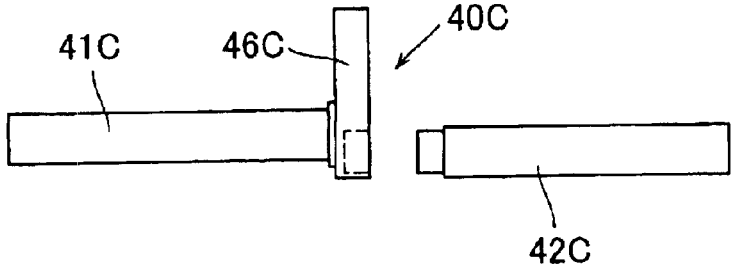
FIG. 10 is a side view of the shaft according to further another embodiment of the invention.

FIG. 10 is a side view of the shaft according to further another embodiment.

As shown in FIG. 10, the shaft 40C of this embodiment has a motor shaft 41C and a mechanism shaft 42C as separate members. A balance weight 46C is integrally formed on the motor shaft 41C. The balance weight 46C is formed with a recess into which an end of the mechanism shaft 42C is fitted. The end of the mechanism shaft 42C is formed with a small-diameter portion.

In the shaft 40C of the embodiment, the mechanism shaft 42C and the balance weight 46C are connected to each other by shrinkage fitting. In this embodiment also, the crank portion is formed by the balance weight 46C.

An assembling method of the air supply apparatus and especially an aligning method of the mechanical portion of the embodiment will be explained next.

Figure 11:
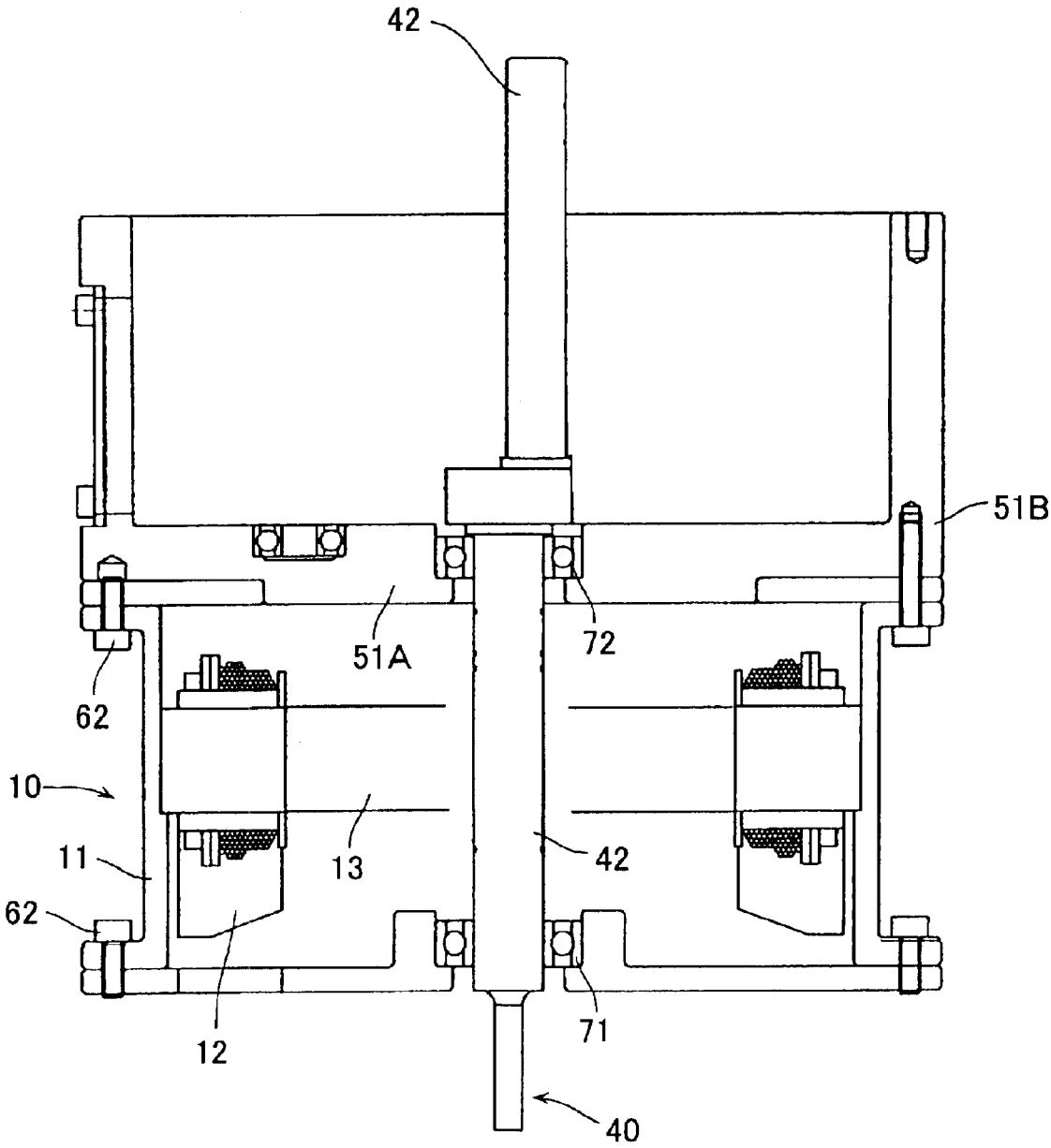
FIG. 11 is a side sectional view for explaining an assembling state of the air supply apparatus of the embodiment.
Figure 12:
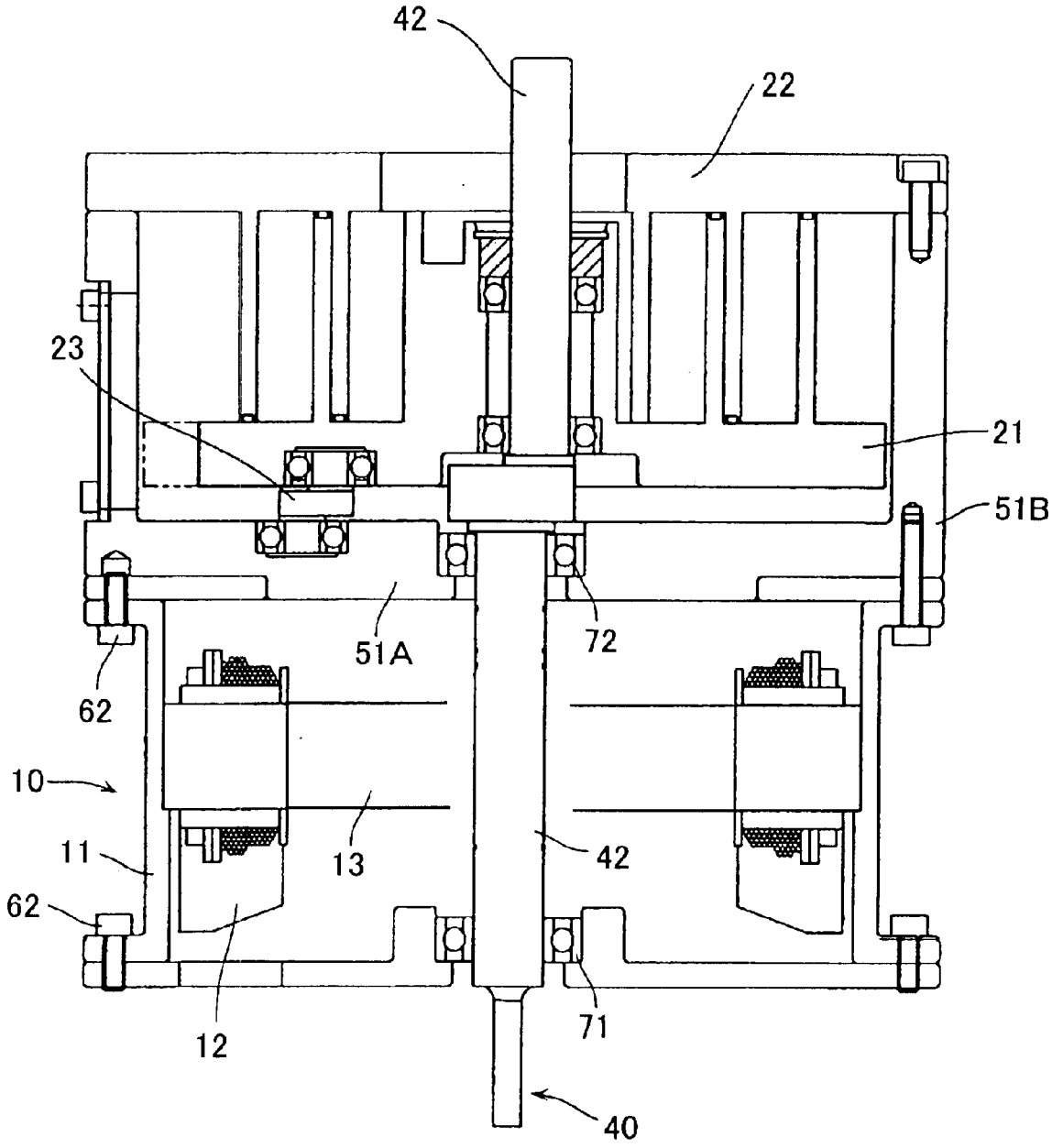
FIG. 12 is a side sectional view for explaining the assembling state of the air supply apparatus of the embodiment.
Figure 13A:
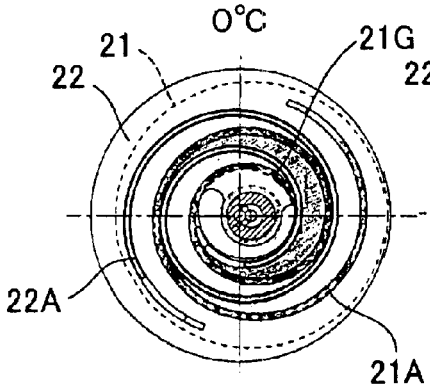
FIG. 13 are views for explaining a compression space formed by turning motion of the orbiting scroll of the embodiment.
Figure 13B:
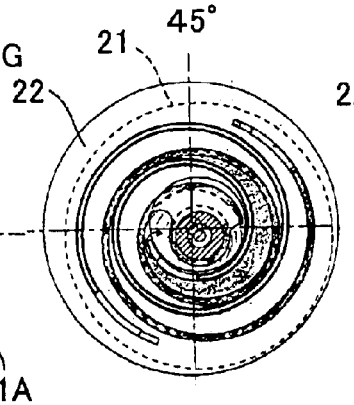
Figure 13C:
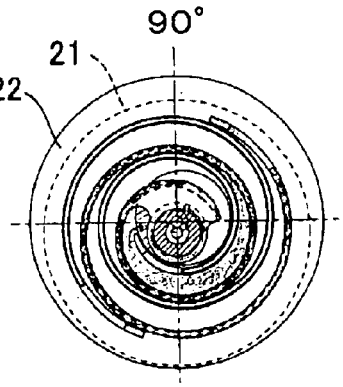
Figure 13H:
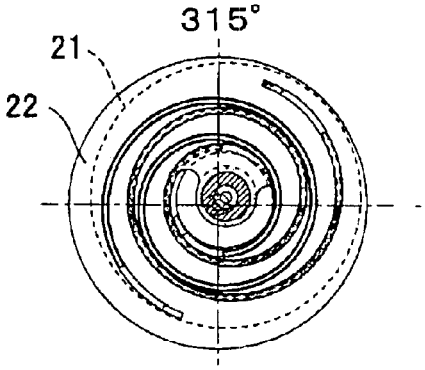
Figure 13D:
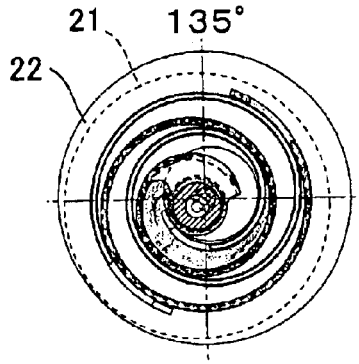
Figure 13G:
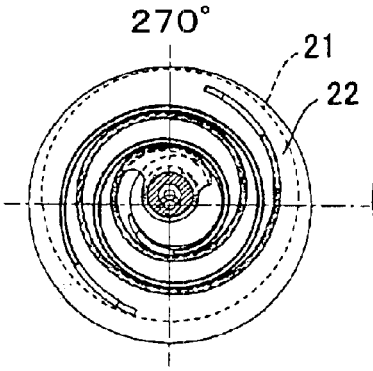
Figure 13F:
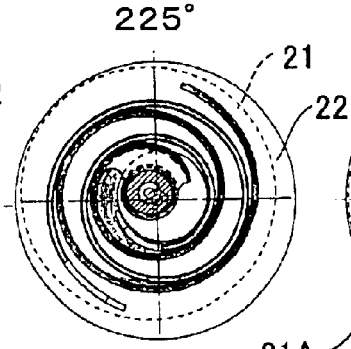
Figure 13E:
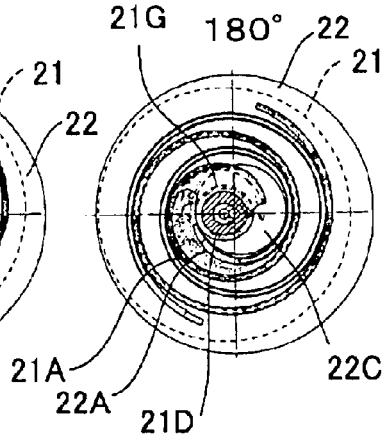

FIGS. 11 and 12 are side sectional views for explaining an assembling state of the air supply apparatus of the embodiment. The same members are designated with the same symbols, and detailed explanation thereof is omitted.

FIG. 11 shows a state before the orbiting scroll 21 and the stationary scroll 22 are assembled.

As shown in FIG. 11, the shaft 40 is already provided in a state in which the motor portion 10 is provided with the first casing 51. Although it is not illustrated, in this state, the motor portion 10 and the first casing 51 are fixed using a jig.

In this manner, in the state before the orbiting scroll 21 and the stationary scroll 22 are assembled, the shaft 40 is held in a state in which the motor portion 10 is assembled. By assembling the motor portion 10 previously in this manner, since the shaft 40 is supported at the two points by the bearing 71 and the bearing 72, it is possible to effectively prevent the shaft 40 from inclining.

In this state, as shown in FIG. 12, the orbiting scroll 21 is inserted into the mechanism shaft 42 from its other end, and the stationary scroll 22 is further inserted to the mechanism shaft 42 from the other end, thereby assembling the mechanical portion. A force is applied to the stationary scroll 22 from a diametrical direction of the shaft 40, thereby aligning the mechanical portion. It is possible to uniform the clearance between the laps by applying forces from a plurality of diametrical directions of the shaft 40.

Although the shaft 40 is supported at two points by previously assembling the motor portion 10 in this embodiment, one end of the motor shaft 41 may be fixed using a jig instead of the bearing 71 without previously assembling the motor portion 10.

FIG. 13 are views for explaining the compression space formed by the turning motion of the orbiting scroll.

FIG. 13(*a*) shows that the compression space before discharging is in a compression complete state. FIGS. 13(*b*), (*c*), (*d*), (*e*), (*f*), (*g*) and (*h*) shows the orbiting scroll 21 which is turned by 45° from FIG. 13(*a*) in this order.

The compression space immediately before discharging shown in FIG. 13(*a*) is then brought into communication with the discharge port 22C to discharge the compressed air as shown in FIGS. 13 (*b*), (*c*) and . . . .

In a state shown in FIG. 13 (*e*), however, the compression spaces other than that of the lap-reinforcing portion 21G are adversely isolated from the discharge port 22C by the orbiting scroll lap 21A, the stationary scroll lap 22A and the boss portion 21D. Therefore, by setting the height of the lap-reinforcing portion 21G lower than that of the orbiting scroll lap 21A as in this embodiment, it is possible to ensure the discharging path for the compressed air.

Although the embodiments have been explained based on the air supply apparatus, the present invention can be applied to other gas compressors such as a compressor for a freezer for example.

As apparent from the above embodiments, according to the present invention, it becomes easy to align the motor shaft and the mechanism shaft to each other, and it is possible to enhance the transmitting efficiency.

Further, according to the invention, it is possible to maintain the clearance between the orbiting scroll lap and the stationary scroll lap at a predetermined distance.

Further, according to the invention, it is possible to prevent the efficiency from being deteriorated by preventing the backflow of the compressed air leaking between the mechanism shaft and the orbiting scroll.

Further, according to the invention, it is possible to restrain the orbiting scroll from capsizing and the vibration at a low speed.

Further, according to the invention, it is possible to prevent the orbiting scroll lap and the stationary scroll lap from being damaged.

Further, according to the invention, it is possible to provide an oilfree air supply apparatus having an increased height of the scroll lap.

What is claimed is:

1. An air supply apparatus comprising a stator fixed to a motor frame, a rotor which is fixed to a motor shaft and rotated in said stator, an orbiting scroll which is operated by a mechanism shaft, a stationary scroll for forming a compression space between the stationary scroll itself and said orbiting scroll, and a rotation-restraint member for orbiting said orbiting scroll, in which said motor shaft and said mechanism shaft are connected to each other, said mechanism shaft passes through said orbiting scroll and said stationary scroll, said mechanism shaft is held by bearings at opposite ends of said orbiting scroll, wherein opposite ends of said motor shaft are rotatably held by a first bearing and a second bearing, opposite ends of said mechanism shaft are held by said second bearing and a third bearing, wherein said mechanism shaft and said motor shaft are integrally formed together, wherein said rotation-restraint member comprises at least one crankpin, and said at least one crankpin is provided at opposite ends with bearings, wherein an orbiting scroll lap having a predetermined height stands on one of surfaces of said orbiting scroll, a boss portion stands from a center portion of said one surface of said orbiting scroll, and a lap-reinforcing portion is formed between an outer peripheral surface of said boss portion and said orbiting scroll lap.

2. An air supply apparatus according to claim 1, wherein a diameter of said mechanism shaft is 1.0 to 1.5 times greater than that of said motor shaft.

3. An air supply apparatus according to claim 1, wherein said orbiting scroll is held by said mechanism shaft using two bearings, a shaft seal is provided between said two bearings.

4. An air supply apparatus according to claim 1, wherein said orbiting scroll is held by said mechanism shaft using a bearing, said air supply apparatus further comprises a pre-load spring for pressing said bearing in a direction in which said orbiting scroll is separated from said stationary scroll.

5. An air supply apparatus according to claim 1, wherein a stationary scroll lap having a predetermined height stands on one of surfaces of said stationary scroll, an outer peripheral-side end and a center-side end of said stationary scroll lap are provided with ribs, each of said ribs is formed by further extending said stationary scroll lap, and a height of said rib is lower than that of said stationary scroll lap.

6. An air supply apparatus according to any one of claims 1 to 5, wherein a crank portion for decentering said mechanism shaft with respect to said motor shaft is provided with a balance weight.

7. An air supply apparatus according to claim 6, wherein said balance weight and said crank portion are integrally formed together.

8. An air supply apparatus according to any one of claims 1 to 5, wherein a clearance is provided between a side surface of said orbiting scroll lap which stands on said orbiting scroll and a side surface of said stationary scroll lap which stands on said stationary scroll so that both said side surfaces do not come into contact with each other.

9. An air supply apparatus according to claim 8, wherein tip end surfaces of said orbiting scroll lap and said stationary scroll lap are respectively provided with tip seals.

10. An air supply apparatus according to any one of claims 1 to 5, wherein said rotation-restraint member comprises three crankpins.

11. An air supply apparatus according to any one of claims 1 to 5, wherein said orbiting scroll is provided at its back surface with a notch for aligning a center of gravity of said orbiting scroll to an axis of said mechanism shaft.

12. An air supply apparatus according to any one of claims 1 to 5, wherein said mechanism shaft is provided at its opposite ends with balance weights.

13. An air supply apparatus comprising a stator fixed to a motor frame, a rotor which is fixed to a motor shaft and rotated in said stator, an orbiting scroll which is operated by a mechanism shaft, a stationary scroll for forming a compression space between the stationary scroll itself and said orbiting scroll, and a rotation-restraint member for orbiting said orbiting scroll, in which said motor shaft and said mechanism shaft are connected to each other, said mechanism shaft passes through said orbiting scroll and said stationary scroll, said mechanism shaft is held by opposite ends of said orbiting scroll, wherein an orbiting scroll lap having a predetermined height stands on one of surfaces of said orbiting scroll, a boss portion stands on a center portion of said orbiting scroll lap, a lap-reinforcing portion is formed between an outer peripheral surface of said boss portion and said orbiting scroll lap, said lap-reinforcing portion is provided from a center-side end of said orbiting scroll lap by a predetermined length at a height lower than said orbiting scroll lap.

14. An air supply apparatus according to claim 13, wherein a diameter of said mechanism shaft is 1.0 to 1.5 times greater than that of said motor shaft.

15. An air supply apparatus according to claim 13, wherein said orbiting scroll is held by said mechanism shaft using two bearings, a shaft seal is provided between said two bearings.

16. An air supply apparatus according to claim 13, wherein said orbiting scroll is held by said mechanism shaft using a bearing, said air supply apparatus further comprises a pre-load spring for pressing said bearing in a direction in which said orbiting scroll is separated from said stationary scroll.

17. An air supply apparatus according to claim 13, wherein a stationary scroll lap having a predetermined height stands on one of surfaces of said stationary scroll, an outer peripheral-side end and a center-side end of said stationary scroll lap are provided with ribs, each of said ribs is formed by further extending said stationary scroll lap, and a height of said rib is lower than that of said stationary scroll lap.

18. An air supply apparatus according to any one of claims 14 to 17, wherein a crank portion for decentering said mechanism shaft with respect to said motor shaft is provided with a balance weight.

19. An air supply apparatus according to claim 18, wherein said balance weight and said crank portion are integrally formed together.

20. An air supply apparatus according to any one of claims 14 to 17, wherein a clearance is provided between a side surface of said orbiting scroll lap which stands on said orbiting scroll and a side surface of said stationary scroll lap which stands on said stationary scroll so that both said side surfaces do not come into contact with each other.

21. An air supply apparatus according to claim 20, wherein tip end surfaces of said orbiting scroll lap and said stationary scroll lap are respectively provided with tip seals.

22. An air supply apparatus according to any one of claims 14 to 17, wherein said rotation-restraint member comprises three crankpins.

23. An air supply apparatus according to any one of claims 14 to 17, wherein said orbiting scroll is provided at its back surface with a notch for aligning a center of gravity of said orbiting scroll to an axis of said mechanism shaft.

24. An air supply apparatus according to any one of claims 14 to 17, wherein said mechanism shaft is provided at its opposite ends with balance weights.

* * * * *